US008672035B2

(12) United States Patent
Telfer

(10) Patent No.: US 8,672,035 B2
(45) Date of Patent: Mar. 18, 2014

(54) DOWNHOLE TOOL OF HIGH PRESSURE OPERATING CYCLE CAPABILITY

(75) Inventor: George Telfer, Abderdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 353 days.

(21) Appl. No.: 13/123,393

(22) PCT Filed: Oct. 20, 2009

(86) PCT No.: PCT/GB2009/051410
§ 371 (c)(1),
(2), (4) Date: May 13, 2011

(87) PCT Pub. No.: WO2010/046695
PCT Pub. Date: Apr. 29, 2010

(65) Prior Publication Data

US 2011/0226491 A1 Sep. 22, 2011

(30) Foreign Application Priority Data

Oct. 21, 2008 (GB) ..... 0819282.5

(51) Int. Cl.
*E21B 34/10* (2006.01)

(52) U.S. Cl.
USPC ..... 166/318; 166/331; 166/332.4

(58) Field of Classification Search
USPC ..... 166/331, 240, 328, 329, 318, 383, 387, 166/193, 194, 332.4
See application file for complete search history.

(56) References Cited

U.S. PATENT DOCUMENTS

| | | | | |
|---|---|---|---|---|
| 1,878,538 | A * | 9/1932 | Reed | 166/150 |
| 1,883,071 | A * | 10/1932 | Stone | 166/194 |
| 4,355,685 | A * | 10/1982 | Beck | 166/240 |
| 4,889,199 | A * | 12/1989 | Lee | 175/317 |
| 6,102,060 | A | 8/2000 | Howlett et al. | |
| 6,173,795 | B1 | 1/2001 | McGarian et al. | |
| 7,337,847 | B2 * | 3/2008 | McGarian et al. | 166/334.4 |
| 7,766,084 | B2 * | 8/2010 | Churchill | 166/320 |
| 2005/0072572 | A1 * | 4/2005 | Churchill | 166/319 |
| 2005/0236162 | A1 | 10/2005 | Badrak et al. | |

FOREIGN PATENT DOCUMENTS

| | | | |
|---|---|---|---|
| GB | 2 428 719 | A | 2/2007 |
| WO | 2008/119931 | A1 | 10/2008 |

OTHER PUBLICATIONS

PCT International Search Report issued in PCT/GB2009/051410, mailed on Jan. 20, 2010, 3 pages.
PCT Written Opinion issued in PCT/GB2009/051410, mailed on Jan. 20, 2010, 5 pages.
Search Report issued by the UK Intellectual Property Office in parent application GB0819282.5, dated Apr. 15, 2009, 3 pages.

* cited by examiner

*Primary Examiner* — Kenneth L Thompson
(74) *Attorney, Agent, or Firm* — Osha Liang LLP

(57) ABSTRACT

A pressurization tool comprises a body for connection to a tubular by box, and pin, and providing for flow of fluid by way of a throughbore of varying cross-section to form chambers. A lower chamber accommodates a spring that contacts a shoulder providing a reaction surface for compression of the spring under applied force. The chamber merges into intermediate chamber that accommodates a movable index sleeve that cooperates with an index pin inserted through the wall of the tool body. Associated with the upper part of the index sleeve is a valve seat assembly, positioned to abut the index sleeve and moveable therewith, said valve seat assembly being configured to receive a plug or ball, and in one unpressurised configuration, is located in a wider chamber that permits fluid flow around the assembly.

20 Claims, 2 Drawing Sheets

DOWNHOLE TOOL OF HIGH PRESSURE OPERATING CYCLE CAPABILITY

FIELD OF THE INVENTION

The present invention relates to a tool for use in the oil and gas industry. In particular, but not exclusively, the present invention relates to a downhole tool adapted to be attached in a tubular string and a method of utilising fluid pressure for repeatable tasks and for testing operations within a wellbore.

BACKGROUND TO THE INVENTION

Oil and gas is recovered by drilling into a hydrocarbon-bearing formation, for which purpose a drill string terminated by a drill bit is used to form a wellbore. The drill string formed from a series of connected drill pipe stands is rotated to remove formation ahead of the drill bit. Drilling mud or other fluid is pumped through the drill string to cool the drill bit, and to aid the passage of drill cuttings from the base of the well to the surface, via an annulus formed between the drill string and the wall of the wellbore.

At fixed intervals, the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, fastened to and extending from the final casing section. The liner may, or may not be, slotted or perforated.

Another method of inserting successive tubulars into the well bore involves a method of coupling a tubular liner to another previously installed tubular member in a borehole by installing a tubular liner and an expansion device into a borehole such that the tubular liner is overlapped with an existing tubular member. A sealed portion of an interior region of the tubular liner is pressurised with injected fluid so that the expansion device may be displaced uphole by the fluid to progressively expand the circumference of the liner.

After a series of liners has been installed, drilling through to increase depth of well bore can be carried out.

Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall. The well is then completed by locating a string of production tubing within the casing/liner, through which well fluids flow to surface.

Completion operations and production can be adversely affected if the casing or liner in the completed wellbore is imperfectly connected, or otherwise damaged. Accordingly pressure testing is normally carried out during installation of the casing or liner and it is essential therefore, to be able to conduct pressure testing selectively at any given depth in the cased/lined wellbore. The ability to repeatedly conduct such tests within the wellbore in a single trip of the workstring is desirable.

Frequently, downhole tools are actuated by means of introducing obturating means into the circulation fluid, such as a plug, ball or dart, said obturating means being carried in the circulating fluid into contact with a seat within the target tool, and thereby effect a restriction in fluid flow, and consequential pressure build-up as pumping of circulation fluid continues. Typically the increased pressure is used to overcome shear fastener retention means in the tool to release a functional component or otherwise reconfigure the tool from a passive mode to an active operational functionality. Thus for example a slidable sleeve within the tool may be displaced to reconfigure flow paths to provide a radial fluid jetting function. When the desired operation has been completed it may be desired to restore the tool to a passive, non-functioning mode, and to re-establish circulation of fluid. This may entail an additional shear step.

Whilst appropriate design of such tools reliant upon use of shear pins can be very effective, it is not unknown for unexpected operational performance, such as premature yielding of the shear pin due to say an unforeseen event such as jarring of the string within the wellbore.

Additionally, when the high pressure required to initiate a shearing event is released suddenly by yielding of the shear pin either at its design yield point or prematurely, two undesirable effects may occur. One consequence is the transmittal of hydraulic shock down the string which may cause damage to downhole equipment or trigger de-stabilisation of unprotected formation, or cause further tools below the intentionally actuated tool to be prematurely actuated. Another consequence arises from the additional fluid pumped into the workstring to create the pressure build up being suddenly released upon the shear event to surge down past the tool which may also have unpredictable and undesired effects.

It would be desirable to address the risks of a shear fastener failure due to unforeseen operational performance conditions.

SUMMARY OF THE INVENTION

The present invention relates to a tool incorporating a valve seat assembly and a throughbore adapted to permit fluid flow. The tool has a first "open" configuration for run-in hole and at least one further configuration wherein multiple pressurisation operations can be accomplished by restriction of fluid flow and control of fluid pressure. A further "open" configuration is provided wherein fluid flow through the tool after a pre-determined number of pressurisation operations has 1 being required.

Thus according to an aspect of the invention there is provided a tool comprising a tubular body adapted to be connected to other tubular bodies, said tool tubular body having a longitudinal throughbore that permits through passage of fluid, and movably positioned within the tubular body there is located an indexing sleeve and biasing means cooperating with the indexing sleeve to position it preferentially within the tubular body in a first configuration, and an index pin located in the tubular body and engaging with the indexing sleeve such that upon relative axial and/or rotational movement thereof different predetermined configurations of the tool are obtainable, and a valve seat associated with the sleeve and adapted to be plugged by obturator means such that fluid pressure can be increased within the tubular body to effect displacement of the indexing sleeve against the biasing means, whereby by control of fluid pressure the tool can be cycled selectively between a configuration in which fluid flow through the tool is restricted and internal pressure can be increased and a configuration in which fluid flow is permitted and internal pressure can be decreased.

The throughbore within the tool body may have differing cross-sectional dimensions to provide accommodation within its length for the biasing means and adjacent indexing sleeve and valve seat, and further providing a bypass channel to permit fluid flow around the valve seat associated with the indexing sleeve in at least one configuration of the tool body.

The biasing means may be a spring located in a spring chamber defined within the throughbore and having an internal shoulder at one end of the chamber against which the spring may react.

Suitable springs include compression springs especially simple springs such as coil springs and disc springs.

Adjacent to the spring chamber, a further chamber accommodates the indexing sleeve and permits longitudinal movement thereof into the spring chamber in response to fluid pressure applied to the valve seat associated with the indexing sleeve when obturating means is lodged in the valve seat.

A wider chamber is provided adjacent to the chamber accommodating the indexing sleeve to accommodate the valve seat and obturating means when pressure upon the biasing means is relaxed so that fluid flow may be restored around the valve seat whenever a desired number of pressurisation operations has been completed.

Thus the wider chamber of the throughbore is provided with sufficient clearance to permit fluid flow around the valve seat when pressure upon the biasing means is relaxed or relieved by bleed off.

The indexing sleeve is designed to provide a track, which may be of a grooved or slotted form to receive at least one follower or index pin, and having angular sections configured to progressively advance the follower or pin in relative motion terms whenever pressure is cycled within the tool.

Instead of providing a groove or slot in the sleeve, the sleeve may be provided with a radially projecting follower or index pin, and the body of the chamber within which the sleeve is movably positioned may be designed to provide a track within which the follower or index pin may be progressively advanced in a similar way by a succession of pressure-up and bleed off steps.

At least one part of the track should permit sufficient movement of the follower or index pin to effect relaxation of spring biasing action to displace the associated valve seat longitudinally within the throughbore into a wider chamber where fluid flow past the valve seat is possible when the obturating means is lodged in the valve seat.

The track may comprise a plurality of opposed short travel slots with inclined surfaces to direct the movement of the pin relative to the track always in one advancing direction between configurations in which high fluid pressure acts to cause the index sleeve to act to compress the biasing spring, and reduced pressure permits the biasing spring to urge the index sleeve to a rest position.

Notably, in the operation of this tool it is not necessary for the obturating means to be released from the valve seat to restore circulation of fluid through the tool. Indeed desirably, the obturating means, such as a plug, ball, dart or the like should be firmly lodged in the valve seat throughout the full number of pressurisation steps to ensure that operation of the tool can be reliably performed at very high pressures (say up to 6000 p.s.i. or above) without bleed past of pressurising fluid whilst the indexing sleeve is being cycled through the sequence of pressure-up and bleed off steps.

Accordingly the index sleeve may be provided with a least one port, preferably several such ports, in proximity to the associated valve seat, and accessing the wider chamber when the biasing means is sufficiently relaxed or uncompressed to urge the valve seat beyond a sealing position with the chamber housing the index sleeve, and thereby form a fluid by-pass channel to re-open the throughbore to fluid flow through the tool body.

A significant advantage of the tool described herein is that in contrast to tools requiring shear fasteners to yield at a given pressure, or tools wherein an obturating plug, ball or dart is "blown" through the tool body after completion of a pressurisation step, there is no sudden transmission of shock, or surge of fluid pressure, and the design of the tool can be very simple with few moving parts.

The tool is easily recovered and re-set for use simply by removing the index pin, restraining the biasing spring in a compressed condition, re-positioning the indexing sleeve to a "start" position, and re-inserting the index pin at a selected place on the track. Thus it is possible to select any suitable number, say 12 pressure-up cycles before tool need be re-set, or a lesser number may be selected by appropriate positioning of the index pin further along the track.

According to another aspect of the invention, there is provided a method of expanding a tubular downhole within a wellbore that comprises providing a tool according to the first aspect and attaching it to an end of a tubular to installed within a wellbore, running the tool and tubular into the wellbore, introducing an obturating means in a circulation fluid into the tool whereby passage of fluid through the tool is restricted sufficiently to allow sufficient high fluid pressure within the tubular to be achieved as to effect plastic deformation and expansion of the tubular cross-section.

The step of expanding a tubular may be carried out by inserting the tool with attached tubular into a previously installed tubular, positioning the attached tubular so as to overlap the installed tubular, and expanding the attached tubular to extend the length of the installed tubular.

The step of expanding a tubular may be applied to a full length of installed tubulars to temporarily expand the installed tubulars to pressure test same.

Additionally, the tool of this invention may be attached to a tubular deforming tool requiring pressure to actuate it whereby tubular deformation is effected at least in part by mechanical contact of a former with the tubular section to be deformed. Typically the deformation step is an expansion step.

DESCRIPTION OF THE DRAWINGS

An embodiment of the present invention will now be described, by way of example only, with reference to the accompanying drawings, in which.

MODES FOR CARRYING OUT THE INVENTION

Figure 1:
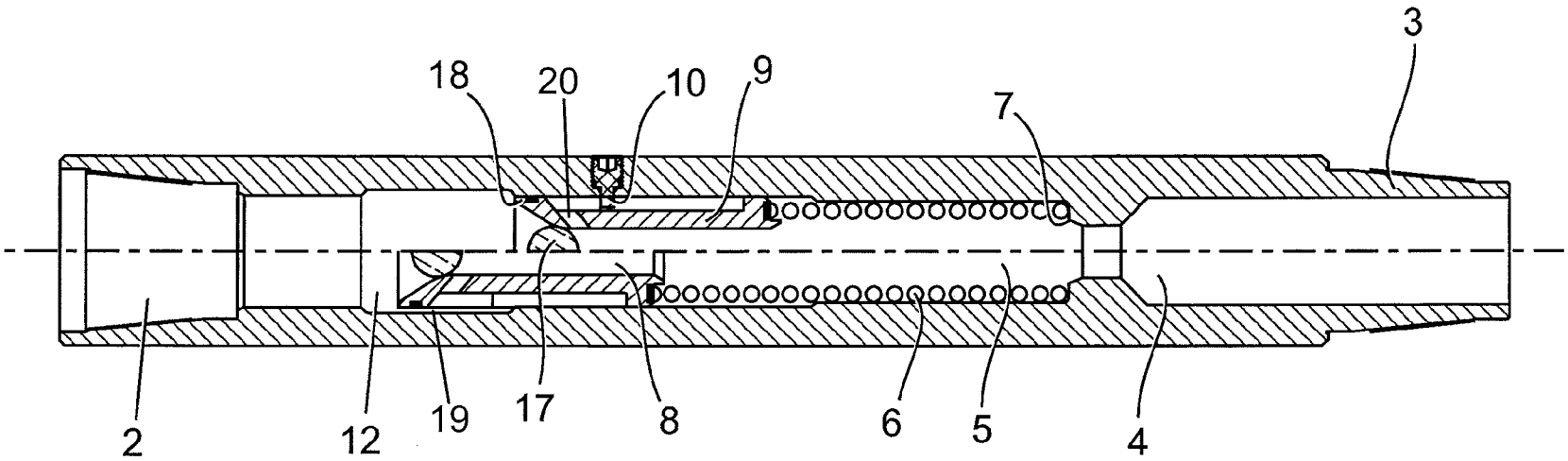
FIG. 1 shows split half-sectional views of the pressurisation tool of this invention respectively shown (a) in the pressurised position, and (b) in the relaxed restored flow by-pass position.
Figure 2:
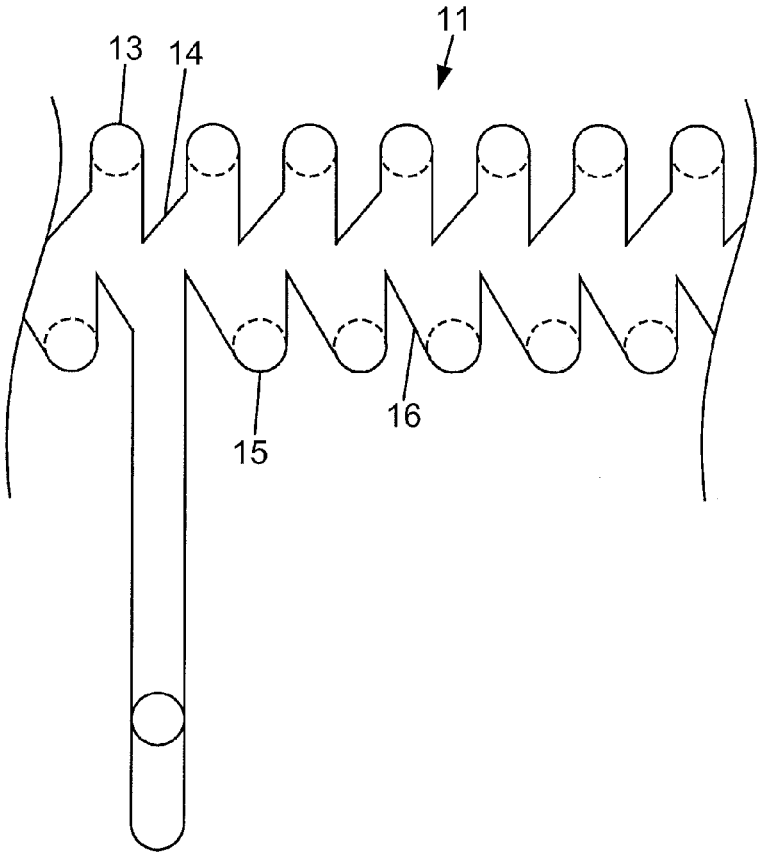
FIG. 2 shows schematically the track defined by the relationship between an indexing sleeve and an index pin to allow repeated pressurisation cycles followed by a relaxation of the tool.

A pressurisation tool for use with tubulars comprises a tool body 1 having means for attachment to a tubular or work string in the form of an upper box section 2, and lower pin section 3, and providing for flow of fluid through the tool body by way of a throughbore 4 of varying cross-section.

The throughbore has several chambers for accommodating operating components. A lower chamber 5 accommodates a compression coil spring 6 that contacts a narrowing of the throughbore in the form of shoulder 7 that provides a reaction surface for compression of the spring under applied force.

The lower chamber 5 merges into an intermediate chamber 8 that accommodates a movable index sleeve 9 capable of both longitudinal translation in the direction of the longitudinal axis of the tool and also rotational movement around that axis within the tool body. That sleeve 9 cooperates with an index pin 10 that can be inserted through the wall of the tool body to project into the intermediate chamber to contact the sleeve.

An upper chamber 12 of wider cross sectional dimensions is located adjacent to the intermediate chamber for purposes to be made clear hereinafter.

The index sleeve 9 is slotted or grooved to define a track 11 having a succession of detent positions or limit stops 13, 15 and directionally disposed inclined cam surfaces 14, 16 to control and direct the travel of the index sleeve with respect to the pin 10 that is fixed in the tool body wall. Thus pressurisation cycles cause the sleeve to move in directions that have both longitudinal and rotational components so that the sleeve moves successively from a first position to a fully rotated position in alternating up and down displacements according to whether pressure is applied compressively against the spring or bled off to allow the spring to relax.

Associated with the upper part of the index sleeve 9 is a valve seat assembly 18, positioned to abut the index sleeve and moveable therewith, said valve seat assembly being configured to receive an obturating means such as a ball 17, in such a way that it becomes firmly lodged in the seat surface and not liable to be shaken loose even if fluid pressure is relieved thereupon. The valve seat assembly is located in a wider cross-sectional dimension of the throughbore in a first configuration of the tool wherein fluid flow is possible through and even around the valve seat assembly (e.g., bypass channel 19, port 20).

In a possible use of the tool for a purpose of pressurising a tubular or string of tubulars connected above the tool, the tool and associated tubulars are positioned within a wellbore, and fluid is circulated therein. A plug in the form of a ball is introduced to the circulating fluid and carried into the tool where it becomes lodged in the seat of the valve assembly. At this point pumping of fluid is continued and the fluid pressure acts to apply a compressive force through the valve seat assembly and index sleeve upon the biasing coil spring 6. The movement of the index sleeve under the applied pressure is limited by the engagement of the index pin in the track, and movement of the sleeve follows the orientation of the inclined surfaces until the pin restrains further movement by virtue of a detent or limit stop. Pressure can be increased to exceptionally high loadings without further movement of components within the tool.

Thus pressures of the order of 3,000-6,000 p.s.i. can be readily achievable without any concerns over shearable fasteners yielding since, unlike in prior art devices, none are present nor required.

As soon as the required purpose of the pressure-up step is realised, then the pressure can be bled off to relax the tool, the biasing spring gradually returning the index sleeve towards its initial longitudinal position, but on account of the location of the index pin within the inclined and directionally disposed slots or grooves in the track of the index sleeve, a turning of the sleeve occurs to present yet another detent or limit stop. At this stage the tool is configured to accept another pressure-up step. This cycle can be repeated for as many times as there are appropriate slots in the sleeve, until the final long travel "rest" slot is encountered at which point the tool has completed its operational cycle and needs to be pulled out for re-setting.

The invention claimed is:

1. A tool comprising:

a tubular body configured to be connected to other tubular bodies, the tubular body having a longitudinal throughbore that permits through passage of fluid;

an indexing sleeve movably positioned within the tubular body;

a biasing member cooperating with the indexing sleeve to position the indexing sleeve within the tubular body in a first configuration;

an index pin located in the tubular body and engaging with the indexing sleeve such that upon axial and/or rotational movement of the index pin relative to the indexing sleeve different predetermined configurations of the tool are obtainable;

a valve seat associated with the indexing sleeve and configured to be plugged by an obturator such that fluid pressure can be increased within the tubular body to displace the indexing sleeve against the biasing member, whereby by control of fluid pressure the tool can be cycled selectively between a configuration in which fluid flow through the tubular body is restricted and internal pressure can be increased and a configuration in which fluid flow through the tubular body is permitted and internal pressure can be decreased; and the indexing sleeve comprising a track configured to receive at least one follower or index pin, wherein at least one part of the track is configured to permit the indexing sleeve to move relative to the follower or index pin to uncompress the biasing member to displace the associated valve seat longitudinally within the throughbore into an upper chamber having a diameter larger than an intermediate chamber housing the indexing sleeve, and wherein the indexing sleeve includes at least one port in proximity to the associated valve seat, and accessing the upper chamber when the biasing member is uncompressed to displace the valve seat beyond a sealing position with the intermediate chamber, and thereby form a fluid by-pass channel to re-open the throughbore to fluid flow through the tubular body.

2. The tool as claimed in claim 1, wherein the throughbore within the tubular body has differing diameters configured to provide accommodation within its length for the biasing member and adjacent indexing sleeve and valve seat, and further providing the fluid by-pass channel to permit fluid flow around the valve seat associated with the indexing sleeve in at least one configuration of the tool.

3. The tool as claimed in claim 1, wherein the biasing member is a spring located in a lower chamber defined within the throughbore and, the lower chamber having an internal shoulder at one end of the chamber against which the spring can react.

4. The tool as claimed in claim 3, wherein the spring comprises at least one compression spring such as a coil spring or a disc spring.

5. The tool as claimed in claim 2, wherein the throughbore comprises a lower chamber configured to receive the biasing member and having an internal shoulder at one end of the lower chamber, the lower chamber having a length configured to receive the indexing sleeve within at least part of said length in at least one configuration of the tool, and the upper chamber having a diameter wider than the lower chamber, the upper chamber configured to accommodate the valve seat with sufficient clearance to permit fluid flow around the valve seat.

6. The tool as claimed in claim 1, wherein the indexing sleeve is configured to provide the track comprising a plurality of grooves configured to receive at least one follower or index pin, the track further comprising a plurality of angular sections configured to progressively advance the follower or index pin relative to the track when pressure is cycled within the tubular body.

7. The tool as claimed in claim 6, wherein progressively advancing the index pin with respect to the track is provided by reciprocation of the tool.

8. The tool as claimed in claim 1, wherein the tool is set for use downhole to adopt configurations by fluid pressure cycling against the biasing member without use of shear fastener means.

9. A method comprising:

providing a tool comprising:

a tubular body configured to be connected to other tubular bodies, the tubular body having a longitudinal throughbore that permits through passage of fluid;

an indexing sleeve movably positioned within the tubular body;

a biasing member cooperating with the indexing sleeve to position the indexing sleeve within the tubular body in a first configuration;

an index pin located in the tubular body and engaging with the indexing sleeve such that upon axial and/or rotational movement of the index pin relative to the indexing sleeve different predetermined configurations of the tool are obtainable; and a valve seat associated with the indexing sleeve and configured to be plugged by an obturator such that fluid pressure can be increased within the tubular body to displace the indexing sleeve against the biasing member, whereby by control of fluid pressure the tool can be cycled selectively between a configuration in which fluid flow through the tubular body is restricted and internal pressure can be increased and a configuration in which fluid flow through the tubular body is permitted and internal pressure can be decreased, and wherein the indexing sleeve includes at least one port in proximity to the associated valve seat, attaching the tool to an end of a tubular to installed within a wellbore;

running the tool and tubular into the wellbore;

introducing the obturator in a circulation fluid into the tool whereby passage of fluid through the tubular body is restricted to allow high fluid pressure within the tubular to be achieved as to effect plastic deformation and expansion of the tubular cross-section; and reducing fluid pressure within the tubular to uncompress the biasing member and form a fluid by-pass channel configured to permit fluid flow around the valve seat.

10. The method of claim 9, further comprising:

operably connecting the tool and a pressure-actuated expansion tool; and actuating the pressure-actuated expansion tool.

11. An tool comprising:

a tubular body comprising a longitudinal throughbore configured to permit fluid flow through;

an index pin disposed in the tubular body;

an indexing sleeve disposed in the throughbore, the indexing sleeve comprising a track, the track comprising a plurality of grooves that are configured to receive the index pin and control movement of the index pin relative to the track;

a valve seat disposed on an end of the indexing sleeve and configured to prevent fluid flow through the tubular body; and a biasing member disposed in the throughbore axially below the indexing sleeve and configured to axially displace the indexing sleeve, wherein the indexing sleeve includes at least one port in proximity to the valve seat, the at least one port configured to by-pass the valve seat and allow fluid flow through the throughbore when the biasing member is sufficiently uncompressed.

12. The tool of claim 11, wherein the valve seat is disposed on an upper end of the indexing sleeve.

13. The tool of claim 12, wherein the valve seat is configured to receive and seal with an obturator.

14. The tool of claim 11 further comprising a lower chamber configured to accommodate the biasing member and at least portion of the indexing sleeve.

15. The tool of claim 14 further comprising an intermediate chamber configured to accommodate the indexing sleeve, wherein the intermediate chamber has a larger diameter than the lower chamber.

16. The tool of claim 15 further comprising an upper chamber having a diameter larger than the intermediate chamber, wherein the port of the indexing sleeve is configured to access the upper chamber when the biasing member is sufficiently uncompressed.

17. The tool of claim 12, wherein the index sleeve is located between the upper chamber and the lower chamber.

18. The tool of claim 14, wherein the upper chamber is configured to provide sufficient clearance between the indexing sleeve to permit fluid flow around the valve seat when pressure displacing the biasing member is relieved.

19. The tool of claim 18, wherein the upper chamber comprises a pressure bleed off mechanism.

20. The tool of claim 18, wherein the valve seat is configured to be sealed by an obturator.

* * * * *